US007288714B1

(12) United States Patent
Hirschmann, Jr. et al.

(10) Patent No.: US 7,288,714 B1
(45) Date of Patent: Oct. 30, 2007

(54) ELECTRICAL ARC FLASH PROTECTION BLANKET

(75) Inventors: Jack B. Hirschmann, Jr., South Dartmouth, MA (US); Thomas E. Neal, Guilford, CT (US)

(73) Assignee: Paramount Corporation, New Bedford, MA (US)

( * ) Notice: Subject to any disclaimer, the term of this patent is extended or adjusted under 35 U.S.C. 154(b) by 0 days.

(21) Appl. No.: 11/548,723

(22) Filed: Oct. 12, 2006

Related U.S. Application Data

(62) Division of application No. 11/038,913, filed on Jan. 20, 2005, now Pat. No. 7,145,072, which is a division of application No. 10/342,801, filed on Jan. 15, 2003, now abandoned.

(51) Int. Cl.
*H01B 3/50* (2006.01)

(52) U.S. Cl. ..... 174/5 R; 174/5 B; 174/1; 174/2

(58) Field of Classification Search ..... 174/1, 174/2, 5 R, 5 SB
See application file for complete search history.

(56) References Cited

U.S. PATENT DOCUMENTS

| | | | | |
|---|---|---|---|---|
| 1,728,545 A | | 9/1929 | Haushalter | |
| 3,135,820 A | | 6/1964 | Hallet, Jr. et al. | |
| 3,864,156 A | | 2/1975 | Weil | |
| 3,919,439 A | | 11/1975 | Perkins et al. | |
| 4,427,745 A | | 1/1984 | Pearson | |
| 4,556,082 A | | 12/1985 | Riley et al. | |
| 4,762,750 A | * | 8/1988 | Girgis et al. | 428/378 |
| 4,879,441 A | | 11/1989 | Hamm et al. | |
| 5,680,944 A | | 10/1997 | Rueter | |
| 5,711,359 A | | 1/1998 | Simon et al. | |
| 5,722,939 A | * | 3/1998 | Hohlen | 602/18 |
| 5,948,708 A | * | 9/1999 | Langley | 442/131 |
| 6,147,333 A | | 11/2000 | Mattson | |
| 6,318,054 B1 | | 11/2001 | Gatto | |

FOREIGN PATENT DOCUMENTS

| | | | |
|---|---|---|---|
| CA | 2066982 A | * | 10/1992 |
| CA | 2066982 A1 | | 10/1992 |

* cited by examiner

*Primary Examiner*—Dhiru R. Patel
(74) *Attorney, Agent, or Firm*—Altman & Martin; Steven K. Martin

(57) ABSTRACT

An electrical arc flash protection blanket for protecting workers from electrical arc flashes. The blanket is composed of two or more layers where the layer closest to the electrical arc source is of a fiberglass material and the remainder of the layers are of fiberglass and/or a flame-retardant (FR) materials. The layers overlap so that the they can be attached around the entire perimeter. Preferred fiberglass fabrics are woven with a warp yarn break strength between about 0.7 and 1.5 times the fill yarn break strength. FR materials include FR cotton, para-aramids, and meta-aramids. A fastening structure is used to install the blanket for use. Contemplated fastening structures include straps with temporary fasteners around the blanket perimeter and eyelets. Optional integral handles facilitate carrying and installation.

20 Claims, 2 Drawing Sheets

ELECTRICAL ARC FLASH PROTECTION BLANKET

CROSS-REFERENCES TO RELATED APPLICATIONS

The present application is a divisional application of application Ser. No. 11/038,913, filed Jan. 20, 2005 now U.S. Pat. No. 7,145,072 for METHOD OF ELECTRICAL ARC FLASH PROTECTION in the names of Jack B. Hirschmann, Jr., and Thomas E. Neal, which is a divisional application of application Ser. No. 10/342,801, filed Jan. 15, 2003 now abandoned for ELECTRICAL ARC PROTECTIVE BLANKET in the names of Jack B. Hirschmann, Jr., and Thomas E. Neal.

STATEMENT REGARDING FEDERALLY SPONSORED RESEARCH OR DEVELOPMENT

Not Applicable

REFERENCE TO A SEQUENCE LISTING, A TABLE, OR A COMPUTER PROGRAM LISTING COMPACT DISK APPENDIX

Not Applicable

BACKGROUND OF THE INVENTION

1. Field of the Invention

The present invention relates to electrical safety, more particularly, to a method of protecting workers from electrical arcs.

2. Description of the Related Art

When working on electrical equipment, there is always the possibility of an occurrence of an electrical arc. Consequently, people working on such environments wear garments specifically designed to protect against such arcing. However, these garments do not protect other equipment nor do they protect persons not wearing the garments that are doing other work in the vicinity. Arc protective blankets and curtains were developed to provide secondary protection for the worker and equipment. The blanket or curtain is hung between the equipment being worked on and the individual and/or other areas to be protected. These blankets are typically composed of one or more layers of a cloth woven from a para-aramid fiber or meta-aramid fiber, such as Dupont's Kevlar or Dupont's Nomex. The strength of the cloth allows the blanket to deflect and/or absorb the energy of an arc, diverting the energy away from the area being protected. Typically, the blanket is damaged or destroyed in the process. Typically, the strength of the blanket is determined by the number of layers of fabric. The greater the number of fabric layers in the blanket, the greater the strength of the blanket to deflect the energy of the electric arc. However, there is also a proportionate increase in blanket weight, space necessary for storage, and cost.

Another deficiency of blankets or curtains composed of fabrics containing para-aramid and meta-aramid fibers is that, at sufficiently high temperatures, temperatures that can easily be reached by electrical arcs, the material will burn and smoke. These materials are fire-retardant, so that when the catalyst (heat or fire) is removed, the fire and smoke cease. However, the fire and smoke that are generated can cause significant problems, particularly in confined spaces, such as underground (utility) vaults.

Another deficiency of these blankets or curtains is that the appearance and strength of these materials when exposed to the sun's ultraviolet (UV) light will degrade, thus reducing its protective characteristics. Thus, careful storage and care are required to minimize the blankets' UV light exposure in order to reduce premature aging and potential failure of these blankets.

Another deficiency of these blankets is susceptibility to degradation when exposed to one or more of a variety of chemical agents that are typical to the environment in which the blankets are used. Exposure to chemical agents such as diacetone or paint thinner can degrade the strength of the blanket, reducing its protective characteristics. Additionally, special care must be taken when cleaning these blankets because these materials are affected by many soaps, cleaning agents, fabric softeners, etc., used in laundering.

The blankets are fitted with a means for attachment. Such means can include straps with buckles or clamps. The straps, typically of Dupont Kevlar, are stitched to the blanket so that they extend from the edges. Buckles or clamps are sewn into the free end. The straps can be made adjustable. Another means for attachment include eyelets through which straps or other line can be threaded. Blankets are also made with integral handles for ease in carrying and hanging.

BRIEF SUMMARY OF THE INVENTION

An object of the present invention is to provide an electrical arc protective blanket that provides equivalent or better protection than blankets of the prior art but that does not smoke or burn when exposed to an electrical arc.

Another object is to provide an electrical arc protective blanket that is not degraded by exposure to sunlight and chemical agents commonly found in the workplace and in laundering.

The present invention is an electrical arc protective blanket composed of two or more layers where the layer closest to the electrical arc source is of a fiberglass material. The remainder of the layers may be a fiberglass material and/or a flame-retardant (FR) material. The layers overlap so that they can be attached around the entire perimeter. In one configuration, the layers are attached only around the perimeter and, in another configuration, the layers are sewn together throughout the blanket. Any method known to the art can be used to attach the layers, including double roll and sew, single roll and sew, sew raw, bind with additional material, and serge.

Preferred fiberglass fabrics for use in the present invention are woven with a warp yarn break strength between about 0.7 and 1.5 times the fill yarn break strength. The fiberglass fabrics should be treated to remove residual lubricants and treatments added for manufacturing/weaving purposes in order to enhance performance and reduce or eliminate flame and smoke.

The contemplated FR materials include FR cotton, para-aramids, such as Dupont's KEVLAR, and meta-aramids, such as Dupont's NOMEX, all of which are well-known in the art.

The blanket includes a fastening structure for installing the blanket appropriately for use. Fastening structures include, but are not limited to, a set of straps with temporary fasteners around the blanket perimeter, eyelets through which external straps, cables, or other lines can be threaded, and combinations thereof. Optionally, the blanket has integral handles to facilitate carrying and installation.

The present invention contemplates a variety of blanket structures including, but not limited to, (1) four layers of a fiberglass material, (2) five layers where the three layers closest to the arc source and the layer farthest from the arc source are of a fiberglass material and the fifth layer is of an FR material, (3) two layers of a fiberglass material, (4) two layers where the layer closest to the arc source is of a fiberglass material and the other layer is of an FR material, (5) three layers of a fiberglass material, and (6) three layers where the two outside layers are of a fiberglass material and the inner layer is of an FR material.

Other objects of the present invention will become apparent in light of the following drawings and detailed description of the invention.

BRIEF DESCRIPTION OF THE DRAWINGS

For a fuller understanding of the nature and object of the present invention, reference is made to the accompanying drawings, wherein.

DETAILED DESCRIPTION OF THE INVENTION

Figure 1:
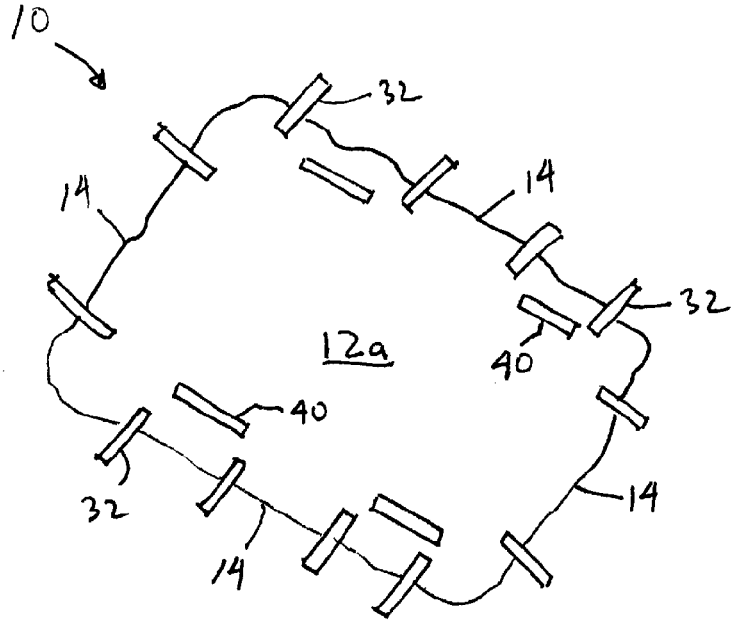
FIG. 1 is a perspective view of the blanket of the present invention including several optional features.

The present invention 10, shown in FIG. 1, is an electrical arc protective blanket composed of two or more layers 12*a*, 12*b* (collectively, 12), at least one layer 12*a*, the layer closest to the electrical arc source, is of a fiberglass material. The remainder of the layers may be composed of a fiberglass material and/or of a flame-retardant (FR) material. Fiberglass is naturally non-combustible, that is, it will not smoke or flame. It will not degrade due to environmental exposure to sunlight and chemicals typically found in the environment in which the blanket 10 will be stored, transported, and used. It is dielectric, so it will not conduct electricity or itself create an arc. It has an excellent cost to weight ratio.

Figure 2:
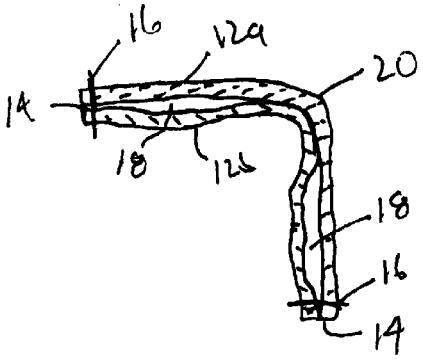
FIG. 2 is a cross-sectional view of a three layer blanket having layers that are attached only at the perimeter.

The layers 12 substantially overlap each other so that the layer perimeters 14 are adjacent to each other. In one configuration, the layers 12 are attached at the perimeters 14, as at 16, but are otherwise unattached so that there is an air gap 18 between the layers 12 over a majority of the blanket area, as in FIG. 2. The air gap 18 shifts depending upon the arrangement of the blanket 10. For example, if there is a fold 20 in the blanket 10, there will most likely not be an air gap 18 at the fold 20; the layers 12 will abut each other. The air gap 18, when present, provides an additional amount of protection because of the insulating nature of air. In another configuration, the layers 12 are sewn together throughout the blanket 10, for example in a rectangular quilted pattern.

Figure 3:
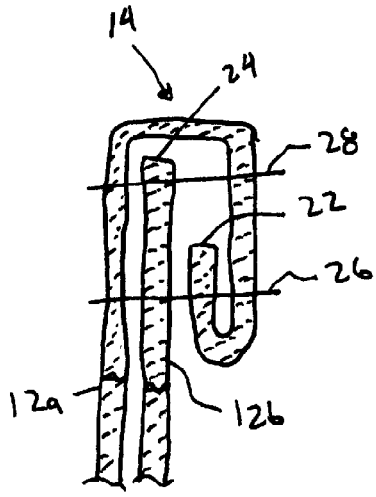
FIG. 3 is a cross-section of a double rolled edge.

There are a number of methods known in the art for attaching the layers 12 at the perimeter. One example is shown in cross-section FIG. 3. The outer layer 12*a* nearest the arc source is cut larger than the other layers 12*b*. The edge 22 of this layer 12*a* is rolled over on itself, and then this rolled edge is rolled over the edges 24 of the other layers 12*b*. This double rolled edge is then stitched through all the layers, as at 26 and 28, to hold the blanket 10 together around the perimeter 14. Stitching is done with an FR thread, such as one composed of a para-aramid or meta-aramid. This rolled edge creates a clean perimeter that is free of raw, frayed edges.

Other methods for attaching the layers include (1) rolling the edge once and sewing, (2) binding the perimeter with a additional material, (3) sewing the edges raw, and (4) serging.

The outer layer 12*a* of the blanket 10 nearest the arc source is composed of a fiberglass fabric. There are quite a number of fiberglass fabrics available on the market, only some of which are appropriate for use in the present invention. Appropriate fiberglass fabrics may be of woven or non-woven construction, and, if woven, the weave may be plain or twill. For cases in which the warp and fill yarn sizes are equal, the fiberglass fabrics which are useful for this application are those in which the number of warp ends per inch is between about 0.7 and 1.5 times the number of fill ends per inch. For cases in which the warp and fill yarn sizes are not equal, the fiberglass fabrics which are useful for this application are those in which the warp yarn break strength is between about 0.7 and 1.5 times the fill yarn break strength. Currently, the most preferred fiberglass fabric is presently denoted by the industry as Style 2523. Its characteristics are as follows:

Warp yarn: ECH 25 1/0
Fill yarn: ECH 25 1/0
Weave style: Plain
Warp count: 28 yarns/in
Fill count: 20 yarns/in
Thickness: 13.0 mils
Weight: 11.6 oz/yd$^2$
Warp breaking strength: 400 lbf/in
Fill breaking strength: 350 lbf/in where ECH 25 1/0 is standard U.S. Glass System nomenclature. This particular glass fiber is composed of electrical glass in a continuous filament that is approximately 0.43 mils in diameter. Electrical glass has a composition of 52-56% silicon dioxide, 16-25% calcium oxide, 12-16% aluminum oxide, 5-10% boron oxide, 0-2% sodium oxide and potassium oxide, 0-5% magnesium oxide, 0.05-0.4% iron oxide, 0-0.8% titanium oxide, and 0-1.0% fluorides. The fiber has a single yarn with a linear density of 2500 yards/pound.

To enhance performance and reduce or eliminate flame and smoke, appropriate fiberglass fabrics should be treated by a heat or chemical process to remove residual lubricants and treatments added for manufacturing/weaving purposes.

As indicated above, there are one or more layers 12*b* in addition to the fiberglass layer 12*a* described above. The addition layer(s) 12*b* may also be composed of a fiberglass fabric and/or may be composed of one or more other FR materials. The fiberglass fabric may be the same as the first layer 12*a* or it may be a different fiberglass fabric, for example, one of different weight.

Various FR materials are contemplated for use in the present invention. These materials include FR cotton, para-aramids, such as Dupont's KEVLAR, and meta-aramids, such as Dupont's NOMEX, all of which are well-known in the art.

Since the fabric layers may be woven, the weaves may be arranged in various ways. The layers may be parallel, that is, the warp and fill of the various layers are parallel. The layers may be perpendicular, that is, the warp and fill of a layer is perpendicular to the warp and fill of at least one other layer. Or the layers may be arranged diagonally, that is, the warp and fill of a layer is at a diagonal relative to the warp and fill of at least one other layer. Finally, the present invention contemplates that there may be various combinations of parallel, perpendicular, and diagonal layers.

Figure 4:
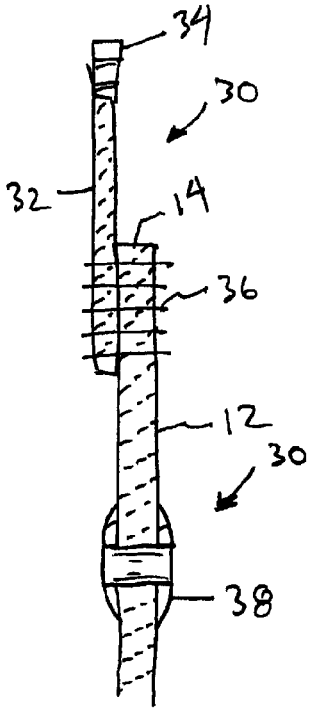
FIG. 4 is a cross-sectional view showing several configurations of fastening structures.

The blanket 10 includes a fastening structure 30 for installing the blanket 10 within its operating environment so that the blanket 10 is properly positioned and retained. The blanket 10 is hung so that it is interposed between the equipment being worked on and the individual and/or other areas to be protected. Typically, the blanket 10 is suspended vertically, but the present invention presumes that it may be installed on a slant or horizontally. Thus, the fastening structure 30 should be capable of such variation in positioning and orientation. Several fastening structures are shown in FIG. 4. One contemplated fastening structure 30 is a set of straps 32 with temporary fasteners 34. The straps 32, typically of the same fiberglass material as the blanket layers 12 or a para-aramid, are stitched to various locations around the perimeter 14 so that they extend from the blanket perimeter 14, as at 36. Typically, there are several straps 32 extending from each side of the blanket, as in FIG. 1. The temporary fasteners 34 are well-known in the art and include, for example, buckles, carabineers, clamps, and hooks. The temporary fasteners 34 are sewn into the free end of the straps 32. Optionally, the strap length is adjustable by means well-known in the art.

Another contemplated fastening structure 30 includes eyelets 38 through which external straps, cables, or other lines can be threaded. The eyelets 38 are well-known in the art and are typically metal, such as brass, or plastic rings crimped into a holes in the blanket, as in FIG. 4.

The present invention contemplates that any other fastening structure 30 appropriate for the expected use of the blanket 10 may be used. The present invention also contemplates that combinations of fastening structures may be incorporated in one blanket.

Optionally, the blanket 10 has integral handles 40 for ease in carrying and hanging. The handles 40 are composed of the same fiberglass or FR materials as can be used in the fabric layers and are sewn to the outer layer(s) near the blanket perimeter 14.

Various examples of configurations of the present invention are described below. The first two examples are configurations that were tested for compliance with accepted industry practices and desired protection capability. The remainder of the examples are contemplated as lower-cost configurations for providing a lesser level of protection where appropriate. The following examples are merely illustrative of possible configurations, and are not intended to be exclusive.

EXAMPLE I

Four-Layer Blanket

Figure 5:
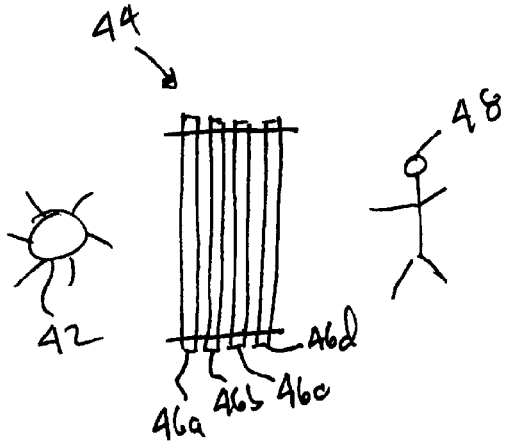
FIG. 5 is a cross-sectional view of the four-layer blanket of Example I.

The four-layer blanket 44 has four layers 46*a*, 46*b*, 46*c*, 46*d* (collectively, 46) of the style 2523 fiberglass material described above. This configuration, shown in FIG. 5, has a minimum thickness of 52 mils, a weight of 46.4 oz/yd$^2$, a warp breaking strength of 1600 lbf/in, and a fill breaking strength of 1400 lbf/in.

The arc test was conducted by shorting out an electrical splice typically found in an underground vault. The splice joined two multi-strand copper conductors which were approximately 1.0 inch in diameter. The cable ends were crimped inside a standard metal splicing device. The cables included several layers of insulation and semi-conductor sheaths, including an outermost lead sheath that is grounded during use. The lead sheaths were connected by a 04 gauge tin-coated copper cable approximately 0.375 inch in diameter in order to maintain the ground connection across the splice. The splice was then wrapped with arc-resistant tape.

The arc was created by simulating a splice failure in a vault environment with a fault current was 25,000 amperes (25 kA) and the voltage was 6800 volts (6.8 kV) for 10 cycles. The simulated splice failure was created by shorting the ground conductor to the main conductor.

The blanket 44 was hung vertically between the splice 42 and a mannequin 48. The mannequin 48 was instrumented with temperature sensors, dressed in FR clothing, and positioned approximately 16 inches from the splice 42.

The test resulted in a minimal degree of afterflame and smoke from the blanket 44. The different layers 46 of the blanket 44 had varying levels of reaction to the arc. The layers 46*a*, 46*b* closest to the splice 42 had greater damage. Between 50% and 70% of material was missing from these layers. The layer 46*d* farthest from the splice 42 remained intact until handled when removed from the test apparatus.

Even with the evident destruction of the blanket 44, there was virtually no evidence of thermal exposure to the mannequin clothing. The only evidence of thermal exposure consisted of a small, slightly charred patch on one knee of the test mannequin 48, determined to have been caused by contamination of the testing environment (a cleaning rag left in the test apparatus).

While prior art blankets provide comparable protection to the user and deflect the energy of the electric arc away from the user, the amount of smoke generated by the materials of the prior art blankets would be substantially greater, creating an additional hazard to the user. Additionally, the blanket 44 of the present invention is superior to blankets of the prior art in that it is essentially unaffected by exposure to UV light and typical workplace chemical agents, both of which have a degrading effect upon the appearance and performance characteristics of prior art blankets.

EXAMPLE II

Five-Layer Blanket

Figure 6:
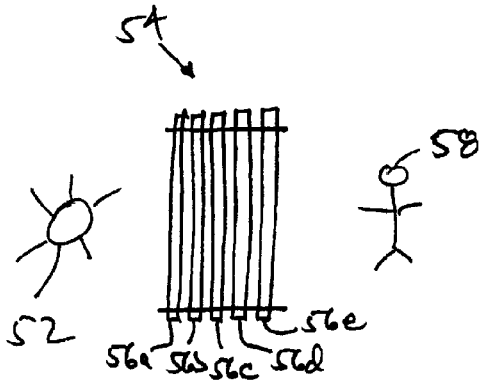
FIG. 6 is a cross-sectional view of the five-layer blanket of Example II.

The five-layer blanket 54, shown in FIG. 6, has four layers of the style 2523 fiberglass material described above and an internal layer of 7.5 oz/yd$^2$ Dupont KEVLAR, arranged as three fiberglass layers 56*a*, 56*b*, 56*c*, one KEVLAR layer 56*d*, and one fiberglass layer 56*e* (collectively, 56). This configuration has a thickness of approximately 62 to 65 mils, a weight of 53.9 oz/yd$^2$, a warp breaking strength of 2600 lbf/in, and a fill breaking strength of 2400 lbf/in.

As with Example I, the test resulted in a minimal degree of afterflame and smoke from the blanket 54. The different layers 56 of the blanket 54 had varying levels of reaction to the arc. The layers 56*a*, 56*b*, 56*c* closest to the arc source 52 had greater damage. Between 50% and 70% of material was missing from these layers. The KEVLAR layer 56*d* had a large missing area of approximately 1 square foot. The fiberglass layer 56*e* farthest from the arc source 52 remained intact until handled when being removed from the test apparatus.

Even with the evident destruction of the blanket 50, there was no evidence of thermal exposure to the mannequin clothing. The blanket 50 provided exemplary protection to the mannequin 58.

As with the four-layer blanket 44 of Example I, the five-layer-blanket 54 provides protection to the user comparable to prior art blankets, but with substantially reduced generated smoke. And it has the same advantages, those of being unaffected by environmental exposure. The FR layer, being internal to the fiberglass layers, is not exposed to UV light and is protected from chemical exposure.

EXAMPLE III

Two-Layer Blanket

The two-layer blanket has two layers of fiberglass material. This blanket configuration will provide adequate protection in relatively low hazardous environments, for example when relatively low voltages and/or currents are present. In addition, it has the advantages of being unaffected by the typical environment in which the blanket will be stored and used.

EXAMPLE IV

Two-Layer FR Blanket

The two-layer FR blanket has one inner layer of fiberglass material described above and one outer layer of FR material. This blanket configuration will provide adequate protection in relatively low hazardous environments, for example when relatively low voltages and/or currents are present.

EXAMPLE V

Three-Layer Blanket

The three-layer blanket has three layers of fiberglass material. This blanket configuration will provide adequate protection in hazardous environments where the two-layer blanket is inappropriate and where the four-layer blanket is not necessary. In addition, it has the advantages of being unaffected by the typical environment in which the blanket will be stored and used.

EXAMPLE VI

Three-Layer FR Blanket

This three-layer FR blanket has an FR layer sandwiched between two layers of fiberglass material. It will provide protection on par with the three-layer blanket of Example V. It has the same advantages of being unaffected by environmental exposure. The FR layer, being inside the fiberglass layers, is not exposed to UV light and is protected from chemical exposure.

Thus it has been shown and described an electrical arc protective blanket which satisfies the objects set forth above.

Since certain changes may be made in the present disclosure without departing from the scope of the present invention, it is intended that all matter described in the foregoing specification and shown in the accompanying drawings be interpreted as illustrative and not in a limiting sense.

We claim:

1. An electrical arc flash protection blanket comprising:

(a) a first fabric layer composed of a first woven fiberglass material and having a first perimeter, said first fabric layer having a warp break strength that is between about 0.7 and 1.5 times a fill break strength;

(b) at least one second fabric layer composed of a material selected from the group consisting of a second woven fiberglass material and a woven fire retardant material, said at least one second fabric layer having a second perimeter;

(c) said first fabric layer and said at least one second fabric layer being substantially overlapping and attached over the entirety of said perimeters; and (d) fastening means for positioning and retaining said blanket in a work environment.

2. The electrical arc flash protection blanket of claim 1 wherein said fiberglass fabric layers are treated to remove substantially all residual lubricants and treatments previously added.

3. The electrical arc flash protection blanket of claim 1 wherein said fabric layers are attached using a double rolled edge, said first fabric layer having the edge that is double rolled.

4. The electrical arc flash protection blanket of claim 1 wherein said first fabric layer is woven with a plain weave from an electrical, continuous filament, single fiberglass yarn having a diameter of approximately 0.43 mils and a linear density of 2500 yards/pound, with a warp count of 28 yarns per inch and a fill count of 20 yarns per inch.

5. The electrical arc flash protection blanket of claim 1 wherein said second fabric layer is composed of said second woven fiberglass material and said second fabric layer has a warp break strength that is between about 0.7 and 1.5 times a fill break strength.

6. The electrical arc flash protection blanket of claim 5 wherein said second fabric layer is woven with a plain weave from an electrical, continuous filament, single fiberglass yarn having a diameter of approximately 0.43 mils and a linear density of 2500 yards/pound, with a warp count of 28 yarns per inch and a fill count of 20 yarns per inch.

7. The electrical arc flash protection blanket of claim 1 wherein said fire retardant material is a material selected from the group consisting of a fire retardant cotton, a para-aramid, and a meta-aramid.

8. The electrical arc flash protection blanket of claim 1 wherein said at least one second fabric layer is comprised of three fabric layers composed of said second woven fiberglass material.

9. The electrical arc flash protection blanket of claim 1 wherein said at least one second fabric layer is comprised of three fabric layers composed of said second woven fiberglass material and a single fabric layer composed of said fire retardant material.

10. The electrical arc flash protection blanket of claim 1 wherein said fastening structure includes a plurality of straps with temporary fasteners arranged around said perimeters.

11. The electrical arc flash protection blanket of claim 1 wherein said fastening structure includes a plurality of eyelets arranged around said perimeters.

12. An electrical arc flash protection blanket comprising:

(a) four fabric layers composed of a woven fiberglass material and having associated perimeters, each of said fabric layers having a warp break strength that is between about 0.7 and 1.5 times a fill break strength, each of said layers having a perimeter;

(b) said fabric layers being substantially overlapping and attached over the entirety of said perimeters using a double rolled edge; and (c) fastening means for positioning and retaining said blanket in a work environment.

13. The electrical arc flash protection blanket of claim 12 wherein said fabric layers are treated to remove substantially all residual lubricants and treatments previously added.

14. The electrical arc flash protection blanket of claim 12 wherein said fabric layers are woven with a plain weave from an electrical, continuous filament, single fiberglass yarn having a diameter of approximately 0.43 mils and a linear density of 2500 yards/pound, with a warp count of 28 yarns per inch and a fill count of 20 yarns per inch.

15. The electrical arc flash protection blanket of claim 12 wherein said fastening structure includes a plurality of straps with temporary fasteners arranged around said perimeters.

16. The electrical arc flash protection blanket of claim 12 wherein said fastening structure includes a plurality of eyelets arranged around said perimeters.

17. An electrical arc flash protection blanket comprising:

(a) four fabric layers composed of a woven fiberglass material and having associated perimeters, each of said fabric layers having a warp break strength that is between about 0.7 and 1.5 times a fill break strength, each of said layers having a perimeter;

(b) a flame retardant fabric layer between two of said fiberglass layers and composed of a material selected from the group consisting of a fire retardant cotton, a para-aramid, and a meta-aramid;

(c) said fabric layers being substantially overlapping and attached over the entirety of said perimeters using a double rolled edge; and (d) fastening means for positioning and retaining said blanket in a work environment.

18. The electrical arc flash protection blanket of claim 17 wherein said fabric layers are woven with a plain weave from an electrical, continuous filament, single fiberglass yarn having a diameter of approximately 0.43 mils and a linear density of 2500 yards/pound, with a warp count of 28 yarns per inch and a fill count of 20 yarns per inch.

19. The electrical arc flash protection blanket of claim 17 wherein said fastening structure includes a plurality of straps with temporary fasteners arranged around said perimeters.

20. The electrical arc flash protection blanket of claim 17 wherein said fastening structure includes a plurality of eyelets arranged around said perimeters.

* * * * *